US006935645B1

(12) United States Patent
Fuhrmeister

(10) Patent No.: US 6,935,645 B1
(45) Date of Patent: Aug. 30, 2005

(54) SKATEBOARD LEASH

(76) Inventor: Cyrus Fuhrmeister, 1506 Venice Blvd., Apt. 208, Venice, CA (US) 90291

( * ) Notice: Subject to any disclaimer, the term of this patent is extended or adjusted under 35 U.S.C. 154(b) by 0 days.

(21) Appl. No.: 10/712,891

(22) Filed: Nov. 12, 2003

(51) Int. Cl.[7] ..... A63C 7/14
(52) U.S. Cl. ..... 280/87.042; 280/809
(58) Field of Search ..... 280/87.042, 809, 280/601, 637, 11.36, 811, 619–622; 441/65, 441/75; 24/607, 907

(56) References Cited

U.S. PATENT DOCUMENTS

| | | | | | |
|---|---|---|---|---|---|
| 1,150,773 | A | | 8/1915 | Chall | |
| 4,025,082 | A | | 5/1977 | Lummus | |
| 4,040,639 | A | * | 8/1977 | Scardenzan | 280/87.042 |
| 4,073,500 | A | | 2/1978 | Campeau | |
| 4,129,313 | A | | 12/1978 | Benson | |
| 4,135,726 | A | | 1/1979 | Beaver | |
| 4,138,128 | A | * | 2/1979 | Criss | 280/16 |
| 4,179,134 | A | | 12/1979 | Atkinson | |
| 4,289,325 | A | * | 9/1981 | Whitacre | 280/87.042 |
| 4,732,400 | A | * | 3/1988 | Santini | 280/87.042 |
| 4,811,971 | A | | 3/1989 | Phillips | |
| 4,887,825 | A | * | 12/1989 | Allen et al. | 280/87.042 |
| 4,915,400 | A | | 4/1990 | Chambers | |
| 4,929,208 | A | | 5/1990 | Corica | |
| 4,990,113 | A | | 2/1991 | Morrison | |
| 5,005,868 | A | | 4/1991 | Stern et al. | |
| 5,020,827 | A | * | 6/1991 | Murdoch | 280/816 |
| 5,026,088 | A | | 6/1991 | Stuart | |
| 5,152,728 | A | * | 10/1992 | Podd, III | 482/51 |
| 5,221,111 | A | * | 6/1993 | Younger | 280/809 |
| 5,284,459 | A | * | 2/1994 | Podd, III | 482/51 |
| 5,492,254 | A | * | 2/1996 | Challoner et al. | 224/586 |
| 5,795,277 | A | * | 8/1998 | Bruntmyer | 482/146 |
| 6,089,592 | A | * | 7/2000 | Negus | 280/620 |
| 6,199,881 | B1 | | 3/2001 | Wood et al. | |
| 6,206,390 | B1 | * | 3/2001 | Borg | 280/87.042 |
| 2004/0195795 | A1 | * | 10/2004 | Huang | 280/87.042 |

* cited by examiner

*Primary Examiner*—J. Allen Shriver
(74) *Attorney, Agent, or Firm*—Jack C. Munro

(57) ABSTRACT

A skateboard leash that is to be held against the rider's feet when the rider is performing aerial maneuvers using the skateboard. The skateboard leash has a mounting strap which is to be wrappable transversely about the skateboard platform. A swivel joint is connected to the mounting strap. A length adjusting strap assembly is connected to the swivel joint. An elongated strap assembly connects to the length adjusting strap with this elongated strap assembly terminating in a bulbous member at its free outer end.

2 Claims, 1 Drawing Sheet

56
2
56
62
60
58
56
54
52
64
42
40
18
42
2
38
3
44
40
24
28
26
22
20
3
66
10
14
16
12
44
48
46
50
38
40
28
36
34
30
24
32
26
20
12

SKATEBOARD LEASH

BACKGROUND OF THE INVENTION

1. Field of the Invention

The present invention is directed to entertainment devices and more particularly to a skateboard and specifically to a leash that is to be attachable to the skateboard which the rider can use to hold the rider's feet against the skateboard while performing aerial maneuvers.

2. Description of the Related Art

Skateboards have been commonly used for many years by young people. Within recent years, the riding of skateboards has developed into a sport. Frequently, the sport includes a multitude of maneuvers most of which are aerial. When performing of an aerial maneuver, the skateboarder requires that the skateboard be held against the rider's feet. If the skateboard becomes separated from the rider's feet, almost invariably the skateboarder will "crash" when landing on the surface after performing of the aerial maneuver.

In the past, in order to keep the skateboard against the rider's feet, it is common for skateboard to manually grasp with one hand the skateboard platform and hold the skateboard platform against the rider's feet. This procedure of holding the skateboard platform requires that the skateboarder assume a crouching position. If the skateboarder could continue in an upright position, the appearance of the aerial maneuver would be substantially enhanced. Additionally, if the skateboarder can remain in a more upright position, a substantially improvement in the aerial maneuver is invariably obtained. The improvement, generally, is related to the skateboarder rising to a greater altitude in performing of the aerial maneuver. If the skateboarder is performing in a tournament and is being judged as to the quality of the aerial maneuvers, the skateboarder would undoubtedly receive higher marks if the skateboarder is in a more upright position than in a crouched position.

Within the prior art, there have been various types of devices used to keep the skateboard platform against the rider's feet when performing of aerial maneuvers. These prior art devices have frequently resulted in a specific configuration of skateboard and such devices are not capable of being used with a conventional skateboard that is purchased within a store. It would be desirable to design a skateboard leash that permits the rider to hold the board against the feet of the rider during all types of aerial maneuvers and the device is capable of being readily attached and detached from a conventional skateboard.

SUMMARY OF THE INVENTION

A basic embodiment of this invention relates to a skateboard leash adapted to be attached to a skateboard which utilizes a mounting strap which is to be mounted transversely across the skateboard platform. A swivel joint mechanism is connected to the mounting strap. An elongated strap assembly is connected to the swivel joint with the elongated strap assembly having an outer free end and at the outer free end is mounted a bulbous member. The bulbous member is adapted to be grasped by the rider with a pulling force to be applied to the elongated strap assembly which will hold the skateboard against the rider's feet when performing aerial maneuvers.

A further embodiment of the present invention is directed to modifying of the basic embodiment by removably securing the mounting strap to the skateboard platform.

A further embodiment of the present invention is directed to the just previous embodiment by modifying the just previous embodiment by including of a buckle in conjunction with the mounting strap.

A further embodiment of the present invention is where the first basic embodiment is modified by the bulbous member mounted at the outer free end being defined as a ball.

A further embodiment of the present invention is where there is included a length adjusting strap assembly located between the swivel joint mechanism and the elongated strap assembly.

A further embodiment of the present invention is where the first basic embodiment is modified by the elongated strap assembly being defined as a folded over inner elastic tube mounted within a covering tube.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figures 1, 2, 3:
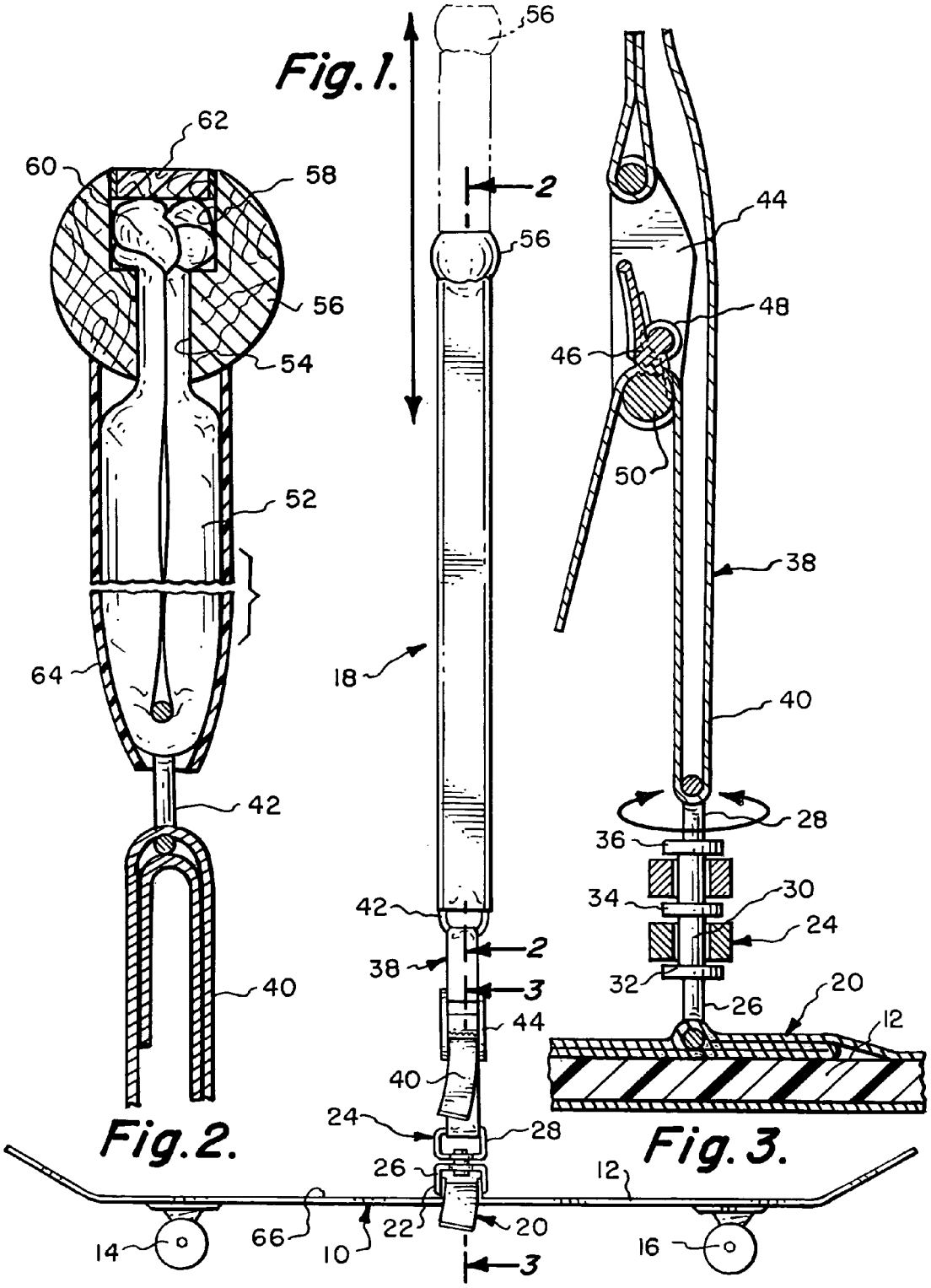
FIG. 1 is a side elevational view of the skateboard leash of the present invention showing the skateboard leash being attached to a skateboard platform.
FIG. 2 is a longitudinal cross-sectional view taken along line 2—2 of FIG. 1 showing in more detail the construction of the elongated strap assembly and the length adjusting strap assembly incorporated in conjunction with the skateboard leash of the present invention.
FIG. 3 is a longitudinal cross-section view taken along line 3—3 of FIG. 1 showing in more detail the length adjusting strap assembly and the swivel joint that is included within the skateboard leash of this invention.

Referring particularly to the drawings, there is shown in FIG. 1 a skateboard 10 which is constructed of a platform 12 upon which is mounted on the undersurface a pair of spaced apart roller trucks 14 and 16. The skateboard leash 18 includes a mounting strap assembly 20 which is composed of a flexible, flat strap 22 which is mounted in conjunction with a buckle assembly (not shown). The mounting strap 22 is to be wrapped transversely around the platform 12 and then by using of the buckle assembly that is tightened securely in position. Typically, mounting strap assembly 20 will be located near the longitudinal center of the platform 12 but may be mounted slightly rearwardly or slightly forwardly according to the individual riders desires. The buckle assembly in conjunction with the mounting strap assembly 20 is deemed to be conventional and forms no specific part of this invention. Actually, any structure would be usable in conjunction with the mounting strap 22 that would snugly tighten the strap assembly 20 onto the skateboard platform 12.

Mounted in conjunction with the mounting strap 22 is a swivel joint assembly 24. The swivel joint assembly 24 includes a first link 26 and a second link 28. The links 26 and 28 are mounted together by a pivot pin 30. The first link 26 is longitudinally held in position between discs 32 and 34 which are mounted on the pivot pin 30. The second link 28 is longitudinally held in position between discs 34 and 36 with disc 36 also being mounted on the pivot pin 30. The result is the second link 28 can freely pivot three hundred and sixty degrees relative to the first link 26. This free pivoting is desirable as during usage of the skateboard leash 18 of this invention the user will frequently twist the leash when making of aerial maneuvers.

Mounted in conjunction with the second link 28 is a flexible strap 40 of a length adjusting strap assembly 38. The strap 40 also connects to a ring 42. The strap 40 also connects to a buckle frame 44 which includes a pivotable lever 46. The pivotable lever 46 is spring biased by a coil spring 48 to a binding position which exerts a clamping action against the strap 40 which is slipped around rod 50 of the buckle frame 44. Manual movement of the pivotable lever 46 away from the clamping position will permit the strap 40 to be moved relative to the buckle frame 44 so that the adjustable strap assembly 38 can be lengthened or shortened according to individual desires. In other words, if a tall rider is using of the skateboard 10 of this invention, then the adjustable strap assembly 38 will be lengthened. If a short rider is using of the skateboard 10, then the adjustable strap assembly 38 will be shortened.

The ring 42 is connected to a folded over section of an elastic tubing 52. Typical elastic tubing would be tubing that resembles a bicycle inner tube. The free ends of the elastic tubing 52 are conducted through narrow hole 54 formed within a bulbous member, such as a ball 56, which may be constructed of wood, plastic or other similar type of material. After the elastic tubing 52 is conducted through the narrow hole 54, it connects with enlarged chamber 58 of the ball 56. The ends of the elastic tubing 52 are then tied into a knot 60 and then permitted to remain within the enlarged chamber 58. Because of the knot 60, the elastic tubing 52 is not capable of withdrawing exteriorly of the narrow hole 54. The enlarged chamber 58 is then closed by means of a plug 62 so the knot 60 will then be hidden from view.

For appearances sake, it is normally desirable to have the elastic tubing 52 to be covered. Therefore, there will be a tube cover 64 located over the elastic tubing 52 and extending between the ball 56 and the ring 42.

The operation of the skateboard leash 18 of this invention is as follows: With the leash 18 mounted to the skateboard platform 12, as shown in FIG. 1, a rider is capable of using a skateboard in a normal manner with the rider's feet (not shown) resting on the upper, surface 66 of the skateboard platform 12. When the rider is performing of aerial maneuvers, the rider is to grab onto ball 56 and will exert a manual pulling force that will tend to maintain the upper surface 66 of the platform 12 in contact with the souls of the shoes of the rider. The fact that the elastic tubing 52 is used, if there is a slight release of the pulling force the elastic stretching of the tubing 52 will retract somewhat but will still maintain the upper surface 66 in contact with the soles of the shoes of the rider of the skateboard 10.

Although the elastic tubing 52 has been shown to be preferable, it is considered to be within the scope of this invention that the other elastic materials could be utilized, such as surgical tubing, a bungee cord or other types of elastic tubing. The skateboard leash 18 of this invention can be used as a training tool for beginners giving the rider an element of comfort when performing of aerial maneuvers. Also, for experienced riders, the skateboard leash 18 of this invention permits the experienced riders to achieve higher in altitude aerial maneuvers and also higher in quality aerial maneuvers. The skateboard leash 18 of this invention enhances the overall fun of the sport of skateboarding.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A skateboard leash adapted to be attached to a skateboard comprising:

a mounting strap adapted to be mounted transversely around a skateboard platform;

a swivel joint mechanism connected to said mounting strap;

an elongated strap assembly connected to said swivel joint, said elongated strap assembly having an outer free end, a bulbous member mounted at said outer free end, whereby said bulbous member is adapted to be grasped by the rider with a pulling force to be applied to said elongated strap assembly which will hold the skateboard against the rider's feet when performing aerial maneuvers; and a length adjusting strap assembly mounted between said swivel joint and said elongated strap assembly, whereby said length adjusting strap assembly is to permit the rider to adjust the overall length of said skateboard leash in order to accommodate to individual requirements.

2. A skateboard leash adapted to be attached to a skateboard comprising:

a mounting strap adapted to be mounted transversely around a skateboard platform;

a swivel joint mechanism connected to said mounting strap;

an elongated strap assembly connected to said swivel joint, said elongated strap assembly having an outer free end, a bulbous member mounted at said outer free end, whereby said bulbous member is adapted to be grasped by the rider with a pulling force to be applied to said elongated strap assembly which will hold the skateboard against the rider's feet when performing aerial maneuvers; and said elongated strap assembly including an folded over inner elastic tube mounted within a covering tube.

* * * * *